US009279096B2

(12) United States Patent
Shulman et al.

(10) Patent No.: US 9,279,096 B2
(45) Date of Patent: Mar. 8, 2016

(54) CLEANING COMPOSITION COMPRISING A BIORENEWABLE SOLVENT COMPRISING A FATTY ACID ETHYL ESTER AND CLEANING METHODS

(75) Inventors: Jan E. Shulman, Newtown, PA (US); Felipe A. Donate, Midland, MI (US); Chaofang Yue, Midland, MI (US)

(73) Assignees: Dow Global Technologies LLC; Rohm and Haas Company

( * ) Notice: Subject to any disclaimer, the term of this patent is extended or adjusted under 35 U.S.C. 154(b) by 0 days.

(21) Appl. No.: 14/130,734

(22) PCT Filed: Aug. 28, 2012

(86) PCT No.: PCT/US2012/052625

§ 371 (c)(1),
(2), (4) Date: Jan. 3, 2014

(87) PCT Pub. No.: WO2013/033071

PCT Pub. Date: Mar. 7, 2013

(65) Prior Publication Data

US 2014/0228272 A1 Aug. 14, 2014

Related U.S. Application Data

(60) Provisional application No. 61/528,433, filed on Aug. 29, 2011.

(51) Int. Cl.

| | |
|---|---|
| ***C11D 1/66*** | (2006.01) |
| ***C11D 3/33*** | (2006.01) |
| ***C11D 3/20*** | (2006.01) |
| ***C11D 3/43*** | (2006.01) |
| ***C11D 7/26*** | (2006.01) |
| ***C11D 7/50*** | (2006.01) |

(52) U.S. Cl.
CPC ..... *C11D 3/2093* (2013.01); *C11D 3/43* (2013.01); *C11D 7/266* (2013.01); *C11D 7/5022* (2013.01)

(58) Field of Classification Search
CPC ..... C11D 11/0023
See application file for complete search history.

(56) References Cited

U.S. PATENT DOCUMENTS

| | | | | |
|---|---|---|---|---|
| 4,116,851 | A * | 9/1978 | Rupe et al. | 134/25.2 |
| 5,736,500 | A | 4/1998 | Farnworth et al. | |
| 5,780,415 | A | 7/1998 | Leonard et al. | |
| 2002/0010114 | A1 | 1/2002 | Dufay et al. | |
| 2004/0058833 | A1 | 3/2004 | Gross et al. | |
| 2004/0258643 | A1 * | 12/2004 | Yaqub et al. | 424/70.2 |
| 2005/0090422 | A1 * | 4/2005 | Lukenbach et al. | 510/417 |
| 2005/0153852 | A1 * | 7/2005 | Evans et al. | 510/130 |
| 2005/0201967 | A1 * | 9/2005 | Albrecht et al. | 424/70.13 |
| 2006/0138399 | A1 * | 6/2006 | Itano et al. | 257/40 |
| 2009/0082239 | A1 * | 3/2009 | Baquete et al. | 510/144 |
| 2009/0176673 | A1 * | 7/2009 | Hanes | 510/100 |
| 2011/0008267 | A1 * | 1/2011 | Arkin et al. | 424/43 |
| 2012/0295831 | A1 * | 11/2012 | Masters | C11D 1/521 510/432 |
| 2013/0344013 | A1 * | 12/2013 | Ikebe et al. | 424/59 |
| 2013/0345110 | A1 | 12/2013 | Volont et al. | |
| 2014/0018434 | A1 * | 1/2014 | James-Meyer | A01N 37/02 514/625 |

FOREIGN PATENT DOCUMENTS

| | | | |
|---|---|---|---|
| JP | 5098297 | A | 4/1993 |
| JP | 2005240015 | A | 9/2005 |
| WO | 2011/121226 | A1 | 10/2011 |

* cited by examiner

*Primary Examiner* — Charles Boyer

(57) ABSTRACT

Described are biorenewable, non-VOC solvents and methods of using the same in cleaning applications.

6 Claims, No Drawings

CLEANING COMPOSITION COMPRISING A BIORENEWABLE SOLVENT COMPRISING A FATTY ACID ETHYL ESTER AND CLEANING METHODS

CROSS REFERENCE TO RELATED APPLICATIONS

This application is a 35 USC §371 national phase filing of PCT/US12/052625 filed Aug. 28, 2012, which claims the benefit of U.S. application No. 61/528,433, filed Aug. 29, 2011.

FIELD

The present invention relates to biorenewable, non-VOC (volatile organic compound), solvents and methods of using the same in cleaning applications.

BACKGROUND

Cleaning compositions must be effective at cleaning, i.e., removing oily or waxy soils. At the same time, there is a balance to be struck between effectiveness in removing soils, inertness to the underlying substrate to be cleaned, and convenience and safety of the user. More recently, there has been a considerable interest in developing environmentally friendly cleaning formulations as well.

While no single definition of "environmentally friendly" exists, it is generally accepted that materials derived from biorenewable resources are sustainable for the environment. Moreover, in some countries, percent by weight volatile organic content (VOC) limits are being regulated. For example, the California Air Resources Board (CARB) has proposed further reductions to VOCs in general purpose cleaners from 4 percent by weight to 0.5 percent by weight by Dec. 31, 2012. For purposes of the application, VOCs are those carbon compounds with a vapor pressure greater than 0.1 mm Hg at 20° C.

Accordingly, a need exists for safe, effective, non-damaging, environmentally friendly cleaning compositions.

DETAILED DESCRIPTION

In one embodiment, the present invention provides a cleaning composition, comprising:

an ester of the formula $R^1C(=O)OR^2$, wherein:

$R^1$ is a $C_{7-40}$ alkyl, and $R^2$ is a $C_{2-6}$ alkyl more preferably $C_{2-4}$ alkyl;

a surfactant;

at least one chelant or hydrotrope; and water.

A "cleaning composition" means a composition for removing soils. A cleaning composition by nature is not to be ingested, nor would one skilled in the cleaning arts look to ingestible compositions to solve cleaning problems.

In one embodiment, $R^1$ is octyl.

In one embodiment, $R^1$ is decyl.

In one embodiment, $R^2$ is ethyl.

In one embodiment, $R^2$ is propyl.

In one embodiment, $R^2$ is butyl or isobutyl.

In a preferred embodiment, the ester is at least one of Ethyl Octanoate, Ethyl Decanoate, Propyl Octanoate, Butyl Octanoate, Isobutyl Octanoate, or Butyl Decanoate or mixtures thereof. In such embodiments, the $R^1$ portions of such esters are derived from coconut oil and palm kernel oil, which upon information and belief are biorenewable. The fatty acids may be fractionated away from other fatty acids by any number of methods, such as distillation. These fatty acids, their esters, or the corresponding alcohols that can be prepared by reduction of them are biorenewable.

In one embodiment, the ester is not a volatile organic (the ester has a vapor pressure less than 0.1 mm Hg at 20° C.). In one embodiment, when $R^1$ is C7, $R^2$ is not ethyl.

In one embodiment, the composition further comprises a co-surfactant or co-solvent for coupling to make the composition clear. In yet another embodiment, the composition is a clear microemulsion.

The surfactant may be nonionic, anionic, cationic, or amphoteric, or mixtures thereof. In one embodiment, the composition includes a cosurfactant for coupling.

Contemplated nonionic surfactants include, for example, polyoxyethylene surfactants; surfactants that are esters of carboxylic acids; surfactants that are ethoxylated natural oils, fats, or waxes; carboxylic amide surfactants; and polyoxyalkylene block copolymer surfactants. Contemplated polyoxyethylene surfactants include, for example, alcohol ethoxylate surfactants and alkylphenol ethoxylates. Contemplated carboxylic acid ester surfactants include, for example, glycerol ester surfactants, surfactants that are esters of glycols (such as, for example, ethylene glycol, diethylene glycol, and 1,2-propane diol), polyethylene glycol ester surfactants, anhydrosorbitol ester surfactants, and ethoxylated anhydrosorbitol ester surfactants. Contemplated carboxylic amide surfactants include, for example, diethanolamide surfactants, monoalkanolamide surfactants, and polyoxyethylene amide surfactants. Contemplated polyoxyalkylene block copolymer surfactants include, for example, poly(oxyethylene-co-oxypropylene) surfactants. Mixtures of contemplated nonionic surfactants are also contemplated.

Contemplated anionic surfactants include, for example, carboxylate surfactants, N-acyl sarcosinate surfactants, acylated protein hydrolysate surfactants, sulfonate surfactants, sulfate surfactants, and phosphate ester surfactants. Contemplated carboxylate surfactants include, for example, alkyl carboxylates, alkenyl carboxylates, and polyalkoxy carboxylates. Contemplated sulfonate surfactants include, for example, alkyl sulfonates, aryl sulfonates, and alkylaryl sulfonates. Some examples of contemplated sulfonate surfactants are alkylbenzene sulfonates, naphthalene sulfonates, alpha-olefin sulfonates, petroleum sulfonates, and sulfonates in which the hydrophobic group includes at least one linkage that is selected from ester linkages, amide linkages, ether linkages (such as, for example, dialkyl sulfosuccinates, amido sulfonates, sulfoalkyl esters of fatty acids, and fatty acid ester sulfonates), and combinations thereof. Some contemplated sulfate surfactants include, for example, alcohol sulfate surfactants, ethoxylated and sulfated alkyl alcohol surfactants, ethoxylated and sulfated alkyl phenol surfactants, sulfated carboxylic acids, sulfated amines, sulfated esters, and sulfated natural oils or fats. Some contemplated phosphate ester surfactants are, for example phosphate monoesters and phosphate diesters. Contemplated anionic surfactants have corresponding cations. Contemplated corresponding cations include, for example, sodium, potassium, ammonium, monoethanolamine, diethanolamine, triethanolamine, magnesium cations, and mixtures thereof.

Contemplated cationic surfactants include, for example, amine surfactants and quaternary ammonium salt surfactants. Contemplated amine surfactants include, for example, primary, secondary, and tertiary alkyl amine surfactants; primary, secondary, and tertiary alkenyl amine surfactants; imidazoline surfactants; amine oxide surfactants; ethoxylated alkylamine surfactants; surfactants that are alkoxylates of ethylene diamine; and amine surfactants where the hydrophobic group contains at least one amide linkage. Contemplated quaternary ammonium salt surfactants include, for example, dialkyldimethylammonium salt surfactants, alkylbenzyldimethylammonium salt surfactants, alkyltrimethylammonium salt surfactants, alkylpyridinium halide surfactants, surfactants made by quaternizing tertiary amine compounds, and esterquats (i.e., surfactants that are quaternary ammonium salts with at least one hydrophobic group that contains an ester linkage). Contemplated quaternary ammonium salt surfactants have corresponding anions. Contemplated corresponding anions include, for example, halide ions (such as, for example, chloride ions), methyl sulfate ions, other anions, and mixtures thereof.

Contemplated amphoteric surfactants include, for example, alkylbetaine surfactants, amidopropylbetaine surfactants, and surfactants that are derivatives of imidazolinium. Mixtures of contemplated amphoteric surfactants are also contemplated.

In one embodiment, one or more hydrotropes are used. Contemplated hydrotropes include, for example, alcohols, glycols, alkanolamines, aryl sulfonates, glycol ethers and mixtures thereof. Contemplated alcohols include, for example, ethanol, isopropyl alcohol, and mixtures thereof. Contemplated glycols include, for example, propylene glycol. Contemplated alkanolamines include, for example, monoethanolamine, ethanolamine, triethanolamine, and mixtures thereof. Contemplated aryl sulfonates include, for example, ammonium xylene sulfonate, sodium xylene sulfonate, potassium xylene sulfonates, sodium methyl naphthalene sulfonate, sodium cumene sulfonate, sodium toluene sulfonate, and mixtures thereof. Contemplated glycol ethers include E-series and P-series glycol ethers by The Dow Chemical Company, for example, dipropylene glycol n-butyl ether, diethylene glycol n-hexyl ether, tripropylene glycol methyl ether dipropylene glycol n-propyl ether, diethylene glycol n-butyl ether, triethylene glycol methyl ether, triethylene glycol ethyl ether, and triethylene glycol n-butyl ether.

Contemplated chelants include, for example, nitrilotriacetic acid, ethylenediaminetetraacetic acid, organic phosphates, sodium tartrate monosuccinate, sodium tartrate disuccinate, and mixtures thereof. Examples include methylglycine N,N-diacetic acid (MGDA), glutamic acid N,N-diacetic acid (GLDA), 2-hydroxyethyliminodiacetic acid (HEIDA), or their salts, or citrate, glucaric and gluconic acid salts.

Contemplated neutral soluble salts include, for example, sodium sulfate.

In one embodiment, the cleaning composition further comprises a builder. Contemplated builders include, for example, phosphates, carbonates, silicates, zeolites, sequestering agents, neutral soluble salts, and mixtures thereof. Contemplated phosphates include, for example sodium tripolyphosphate, tetrasodium pyrophosphate, trisodium orthophosphate, tetrapotassium pyrophosphate, other phosphates, and mixtures thereof. Contemplated carbonates include, for example, sodium carbonate, sodium bicarbonate, sodium sesquicarbonate, and mixtures thereof. Contemplated silicates include, for example, sodium silicates, such as, for example, sodium silicates with a ratio of SiO2 to Na2O of higher than 1:1, for example those with such a ratio of 2.0:1 to 2.4:1. Type A zeolites are examples of contemplated zeolites.

Modifications within the scope of the invention are contemplated, for example, in one embodiment, the cleaning composition contains no glycol ether.

pH ranges from 2 to 12 are contemplated. In one embodiment, the pH of the cleaning composition is at least 8, preferably at least 8, preferably at least 9, preferably at least 10, and more preferably, greater than (>) 10. Alternatively, in one embodiment, the pH is 8 and the cleaning compositions is still suitably effective (see Table 5).

In one embodiment, the present invention provides a method of removing a greasy soil, comprising applying the cleaning composition as defined in the claims to the soil. In one embodiment, the soil is a waxy soil with an entrained pigment.

In one embodiment, the present invention provides a method of making a degreasing surface cleanser, comprising incorporating into the cleanser an ester of the formula $R^1(=O)OR^2$, as described above.

In one embodiment, the cleaning composition contains no glycol ether.

In one embodiment, the composition is a clear homogeneous liquid or gel. In one embodiment, the composition is used in home cleaning. In one embodiment, the composition is used in industrial or institutional cleaning.

In an alternative embodiment of the present invention, instead of $C_{7-10}$ alkyl, $R^1$ can be $C_{11-17}$ alkyl or alkenyl, i.e., have one or more double bonds. In such embodiments, the ester must be selected such that the ester is not a volatile organic (the ester has a vapor pressure greater than 0.1 mm Hg at 20° C.).

EXAMPLES

The following examples are for illustrative purposes only and are not intended to limit the scope of the present invention. All percentages are by weight unless otherwise specified.

Example 1

Examples of cleaning compositions of the present invention are listed in TABLE 1, in wt %:

TABLE 1

| | Batch A | Batch B | Batch C | Batch D | Batch E | Batch F |
|---|---|---|---|---|---|---|
| Ethyl Octanoate | 5 | — | — | — | — | — |
| Ethyl Decanoate | — | 5 | — | — | — | — |
| Propyl Octanoate | — | — | 5 | — | — | — |
| Butyl Octanoate, | — | — | — | 5 | — | — |
| Isobutyl Octanoate | — | — | — | — | 5 | — |
| Butyl Decanoate | — | — | — | — | — | 5 |
| ECOSURF EH-6 Nonionic Surfactant | 10 | 10 | 10 | 10 | 10 | 10 |
| VERSENE 100 chelant | 3 | 3 | 3 | 3 | 3 | 3 |
| Sodium Xylene Sulfonate | 0.5 | 0.5 | 0.5 | 0.5 | 0.5 | 0.5 |
| Deionized Water | Balance | Balance | Balance | Balance | Balance | Balance |

Ingredients are combined in a conventional manner. Each batch is divided, with portions being pH adjusted with citric acid to 8, or 12.

Example 2—Comparative

Examples of comparative cleaning compositions are listed in TABLE 2, in wt %:

TABLE 2

| | Comparative Batch 1 | Comparative Batch 2 | Comparative Batch 3 |
|---|---|---|---|
| Hexyl CARBITOL Glycol Ether | 5 | — | — |
| Hexyl CELLOSOLVE Glycol Ether | — | 5 | — |
| Butyl CELLOSOLVE Glycol Ether | — | — | 5 |
| ECOSURF EH-6 Nonionic Surfactant | 10 | 10 | 10 |
| VERSENE 100 chelant | 3 | 3 | 3 |
| Sodium Xylene Sulfonate | 0.5 | 0.5 | 0.5 |
| Deionized Water | Balance | Balance | Balance |

Ingredients are combined in a conventional manner. Each batch is divided, with portions being pH adjusted with citric acid to 8 or 12.

Example 3

To test the cleaning efficacy of cleaning compositions from Examples 1 and 2, each batch is diluted eight-fold (effective cleaning active dilution from 5 wt % to 0.625 wt %). The batches are prepared as described above, and listed in Table 3.

Frosted glass substrates are prepared by manual sanding, onto which each soil (crayon available from DOLLAR TREE, CRAYOLA™ crayon available from Crayola LLC, and Maybelline ruby 400 lipstick) are drawn into straight lines. A metal template was mechanically sealed onto the glass, dividing the glass into twenty four 15 $mm^2$ arrays. An amount of 500 μl of each batch is pipetted onto each array, and the glass substrate is then shaken for 32 min at a relatively slow speed of about 60 movements per minute. Afterwards, the glass substrate is gently rinsed with tap water and allowed to dry. Once dry, the glass substrate is imaged by optical scanning (EPSON Perfection 4490 scanner, conventional settings). The scanning data is segregated into four groups: "0"—not cleaned at all, "1"—partially cleaned, "2"—most cleaned, "3"—trace left, and "4"—soil completely off, as displayed in Table 3 as an average where multiple measurements were taken.

TABLE 3

| | Batch A | Batch B | Batch C | Batch D | Batch E | Batch F | Comp. Batch 1 | Comp. Batch 2 | Comp. Batch 3 |
|---|---|---|---|---|---|---|---|---|---|
| Crayon | | | | | | | | | |
| pH 8 | 2.3 | 2 | 2 | 2.5 | 2 | 2.5 | 2 | 1 | 2 |
| pH 12 | 3.3 | 3 | 4 | 3.5 | 3 | 3.5 | 3 | 3 | 2.5 |
| Lipstick | | | | | | | | | |
| pH 8 | 2 | 1 | 1 | 2 | 3 | 2 | 3 | 1 | 1 |
| pH 12 | 4 | 4 | 3 | 4 | 4 | 4 | 4 | 2 | 4 |
| CRAYOLA ™ crayon | | | | | | | | | |
| pH 8 | 2 | 2 | 2 | — | — | — | 1 | 1 | — |
| pH 12 | 2 | 2 | 3 | — | — | — | 1 | 1 | 1 |

Overall, the inventive solutions were comparable or better than the conventional solvents comparing soil to soil most times. Although pH obviously was important for efficacy in some soils, the average cleaning efficacy ("cleaning power") from Table 3 is reported in Table 4:

TABLE 4

| | Batch A | Batch B | Batch C | Batch D | Batch E | Batch F | Comp. Batch 1 | Comp. Batch 2 | Comp. Batch 3 |
|---|---|---|---|---|---|---|---|---|---|
| Cleaning Power | 2.8 | 2.3 | 2.5 | 3.0 | 2.8 | 3.0 | 2.3 | 1.5 | 2.2 |

For pH 8, the cleaning power is even more differentiated, as shown in Table 5:

TABLE 5

| | Batch A | Batch B | Batch C | Batch D | Batch E | Batch F | Comp. Batch 1 | Comp. Batch 2 | Comp. Batch 3 |
|---|---|---|---|---|---|---|---|---|---|
| Cleaning Power | 2.2 | 1.7 | 1.7 | 2.3 | 2.3 | 2.3 | 2.0 | 1.0 | 1.5 |

Based on the foregoing, the compositions of the present invention are contemplated degreasers in aqueous cleaning compositions, with the added advantage of being derived from biorenewable sources, and in some embodiments, non-VOC.

Example 4

Examples of cleaning compositions of the present invention are listed in TABLES 6A and 6B, in wt %:

TABLE 6A

| | Batch G | Batch H | Batch I | Batch J | Batch K |
|---|---|---|---|---|---|
| Ethyl octanoate | 1 | 1 | 1 | 1 | 1 |
| Ethyl decanoate | — | — | — | — | — |
| Sodium carbonate | 0.1 | 0.1 | 0.1 | 0.1 | 0.1 |
| Sodium bicarbonate | 0.72 | 0.72 | 0.74 | 0.73 | 0.73 |
| ECOSURF SA-4 surfactant | — | 2 | — | — | 2 |
| ECOSURF EH-3 surfactant | 2 | — | — | 1 | — |
| NACCONOL 90G surfactant | 1 | 1.5 | 1 | 1 | 0.5 |
| Hexyl CELLOSOLVE | — | — | 0.5 | 0.5 | — |
| Deionized Water | Balance | Balance | Balance | Balance | Balance |

TABLE 6B

| | Batch L | Batch M | Batch N | Batch O | Batch P |
|---|---|---|---|---|---|
| Ethyl octanoate | — | — | — | — | — |
| Ethyl decanoate | 1 | 1 | 1 | 1 | 1 |
| Sodium carbonate | 0.1 | 0.1 | 0.1 | 0.1 | 0.1 |
| Sodium bicarbonate | 0.72 | 0.72 | 0.74 | 0.73 | 0.73 |
| ECOSURF SA-4 surfactant | — | 2 | — | — | 2 |
| ECOSURF EH-3 surfactant | 2 | — | — | 1 | — |
| NACCONOL 90G surfactant | 1 | 1.5 | 1 | 1 | 0.5 |
| Hexyl CELLOSOLVE | — | — | 0.5 | 0.5 | — |
| Deionized Water | Balance | Balance | Balance | Balance | Balance |

The formulations were prepared at room temperature by dissolving the buffering electrolytes (sodium carbonate and sodium bicarbonate) in deionnized water, then dissolving linear sodium dodecylbenzene sulfonate (NACCONOL 90G), followed by sequentially adding ECOSURF surfactant (if any), hexyl cellosolve (if any), and acid ester solvent (ethyl decanoate or ethyl octanoate) to form a stable homogeneous microemulsion. The pH of the formulations was 9.2.

Example 5

To test the cleaning efficacy of cleaning compositions from Example 4, each batch is prepared as described above, and listed in Table 7.

Frosted glass substrates are prepared by manual or machine sanding, onto which each soil (generic crayon available from DOLLAR TREE, CRAYOLA ™ crayon available from Crayola LLC, Sharpie® Metallic Silver marker, and Sharpie® black permanent marker) are drawn into straight lines. A metal template was mechanically sealed onto the glass, dividing the glass into twenty four 15 mm by 15 mm arrays. An amount of 500 μl of each batch is pipetted onto each array, and the glass substrate is then shaken for 10 min (for the case of Sharpie® Metallic Silver marker) or 32 min (for the cases of crayon, crayola™, and Sharpie® black permanent marker) at a relatively slow speed of about 60 movements per minute. Afterwards, the glass substrate is gently rinsed with tap water and allowed to dry. Once dry, the glass substrate is imaged by optical scanning (EPSON Perfection 4490 scanner, conventional settings). The scanning data is segregated into four groups by visual observation: "0"—not cleaned at all, "1"—marginally cleaned, "2"—partially cleaned, "3"—mostly cleaned, and "4"—completely cleaned. One to multiple glass substrates were run, and averaged cleaning scores are summarized in the following table.

TABLE 7

| | Crayon (generic and Crayola brand) cleaning power | Silver marker cleaning power | Black marker cleaning power |
|---|---|---|---|
| Batch G | 2.2 | 4 | 2.5 |
| Batch H | 2.7 | 4 | 1 |
| Batch I | 3.3 | 4 | 3 |
| Batch J | 3.3 | 4 | 3 |
| Batch K | 2.7 | 4 | 2 |
| Batch L | 2.5 | 4 | 1 |

TABLE 7-continued

| | Crayon (generic and Crayola brand) cleaning power | Silver marker cleaning power | Black marker cleaning power |
|---|---|---|---|
| Batch M | 1.7 | 4 | 0 |
| Batch N | 3.7 | 4 | 1 |
| Batch O | 2.5 | 4 | 2 |
| Batch P | 2.2 | 4 | 1 |
| Comparative Green Works ® all purpose cleaner (97% naturally derived) | 1.8 | 0 | 1 |
| Comparative Seventh generation ™ natural all purpose cleaner | 2 | 0 | 2 |

As can be seen in TABLE 7, all inventive batches except Batch M out-performed the commercially available conventional all purpose cleaners on crayon. All inventive batches cleaned silver metallic permanent marker very efficiently, whereas the comparative all purpose cleaners were ineffective. Inventive Batches G, I, and J cleaned black permanent marker better than the comparative all purpose cleaners.

It is understood that the present invention is not limited to the embodiments specifically disclosed and exemplified herein. Various modifications of the invention will be apparent to those skilled in the art. Such changes and modifications may be made without departing from the scope of the appended claims.

Moreover, each recited range includes all combinations and subcombinations of ranges, as well as specific numerals contained therein. Additionally, the disclosures of each patent, patent application, and publication cited or described in this document are hereby incorporated herein by reference, in their entireties.

The invention claimed is:

1. A cleaning composition, consisting essentially of:

from 1 to 5 weight percent, based on the total weight of the composition, of a cleaning solvent that is an ester of the formula $R^1C(=O)OR^2$, wherein:

$R^1$ is a $C_{11-17}$ alkyl, and $R^2$ is ethyl;

a surfactant;

at least one chelant or hydrotrope; and water;

wherein the ester has a vapor pressure less than 0.1 mm Hg at 20° C., and wherein the cleaning composition is a non-VOC composition and contains no carbon compound having a vapor pressure greater than 0.1 mm Hg at 20° C.

2. The cleaning composition of claim 1, further comprising a builder.

3. The cleaning composition of claim 1, further comprising additional surfactants.

4. The cleaning composition of claim 1, wherein the pH of the cleaning composition is at least 8.

5. A method of removing a greasy soil, comprising applying the cleaning composition of claim 1 to the soil.

6. A method of making the cleaning composition of claim 1 comprising combining the ingredients in a conventional manner.

* * * * *